United States Patent [19]

Serge

[11] Patent Number: 4,787,182

[45] Date of Patent: Nov. 29, 1988

[54] DISPLACEABLE OPENABLE AND CLOSABLE COVERING STRUCTURE

[75] Inventor: Gillard Serge, Bois Le Roi, France

[73] Assignee: G. Gillard et Cie, France

[21] Appl. No.: 53,691

[22] Filed: May 26, 1987

[30] Foreign Application Priority Data

Jun. 6, 1986 [FR] France ..... 86 08189

[51] Int. Cl.[4] ..... E04B 7/00

[52] U.S. Cl. ..... 52/82; 52/111; 52/641; 135/109; 135/905; 403/172; 403/176

[58] Field of Search ..... 403/170–172, 403/176; 52/18, 65, 67, 71, 108, 109, 483, 641, 643, 741, 82, 143, 111; 135/106, 109–111, 905, DIG. 8, 103, 104; 160/53; 474/209, 218, 219

[56] References Cited

U.S. PATENT DOCUMENTS

| | | | |
|---|---|---|---|
| 1,418,608 | 6/1922 | Akers | 135/103 |
| 2,260,369 | 10/1941 | Ebenhack | 52/69 |
| 3,017,893 | 1/1962 | Greenbie | 135/109 |
| 3,138,828 | 6/1964 | Greenbie | 52/90 |
| 3,368,575 | 2/1968 | Besonen | 135/109 |
| 4,070,846 | 1/1978 | Sohlberg | 52/641 |
| 4,170,852 | 10/1979 | Danis, Jr. | 52/71 |
| 4,192,334 | 3/1980 | Daws | 135/4 R |
| 4,450,851 | 5/1984 | Beavers | 135/109 |

FOREIGN PATENT DOCUMENTS 0051724 5/1982 European Pat. Off. .

*Primary Examiner*—David A. Scherbel
*Assistant Examiner*—Andrew J. Rudy
*Attorney, Agent, or Firm*—Griffin, Branigan & Butler

[57] ABSTRACT

A central hub carries a main pivotal shaft, on respective sides of which extend pivotal links, to each of which is fixed an end of a truss which trusses can be moved together and parallel when the links are in a straight line for displacement of the structure, and can be spaced and radiating when the links are disposed along a closed contour, for use of the structure.

11 Claims, 7 Drawing Sheets

DISPLACEABLE OPENABLE AND CLOSABLE COVERING STRUCTURE

FIELD OF THE INVENTION

The invention concerns a structure which is easily displaceable from one point to another because it is of an openable and closable design and is capable of serving primarily but not exclusively as a covering structure similar to a framework.

By virtue of the above-mentioned design, the structure of the invention can be advantageously used to provide cover for shelters for short-term use of the kind such as tents for fairs or exhibitions, etc, and also can provide temporary shelters which have to be put up very quickly in the case of natural disasters or the like such as earthquakes, floods, etc. However, although reference is made hereinafter to such a use of the structure of the invention, it will be appreciated that other uses thereof are possible.

SUMMARY OF THE INVENTION

A structure according to the invention comprises a main pivotal shaft which is vertical in position during use; two first horizontal links are pivoted by a first end portion about said main pivotal shaft to extend on two opposite sides of said shaft, each link having a central truss fixing zone and a second end portion provided with a vertical pivotal connecting axis; a succession of supplementary links follow each other from the two first links, being pivotally connected in twos by a secondary vertical pivotal connecting axis and each having a central truss fixing zone; a plurality of trusses which are equal in number of the number of links extend respectively from each link in a vertical plane perpendicular to said link, each truss having a first end by way of which it is rigidly fixed to the central zone of a corresponding link and a second end remote from said link; at least one frame extends in a vertical plane between the successive trusses of each pair of two adjacent trusses; said frame is pivotally connected by the ends thereof to the two trusses and it is itself pivoted at its centre about a vertical folding axis; a folding and unfolding jack is mounted between the two trusses of each pair of successive trusses and it is pivotally connected by way of one end to one of the two links connected to said trusses and its other end is pivoted with respect to the central portion of the folding frame mounted between said two trusses; support posts or equivalent elements such as gantries are pivoted at their upper end about horizontal axes provided at the second end of certain trusses at least for the folding frame which connects them.

On each side of the main pivotal shaft, the succession of links terminates with a terminal link whose second end or free end is provided with a support and fixing means such that the two terminal links can be firmly fixed together when they are brought together as the result of a general pivotal movement through 360° of the links about the main pivotal shaft and a pivotal movement about the secondary pivotal axes.

In accordance with an improvement of the invention, for structures for covering a substantial area, being for example 18 meters in diameter or more, there is a central hub which is vertical in the position of use; said hub is disposed at the centre of the links when they are disposed along a closed contour, the two terminal links being fixed together; a carrier frame arrangement rigidly connects the central hub to the main pivotal shaft and a perimetric guide of a configuration identical to that of said closed contour is supported by radial arms which extend from the central hub; the links are applied by way of a side face against said guide when they are disposed along said closed contour.

In either case, the lower portion of the central pivotal shaft or the lower portion of the central hub is designed to be able to engage with an upper end portion of a lift member such as a jack which is installed vertically on a transportation vehicle.

A description of a preferred embodiment of the invention will now be set forth solely by way of example, in the case of a structure for covering a large area of more than 18 meters in diameter, comprising a central hub. Reference will be made to the accompanying drawings in which:

DESCRIPTION OF THE PREFERRED EMBODIMENTS

Figure 1:
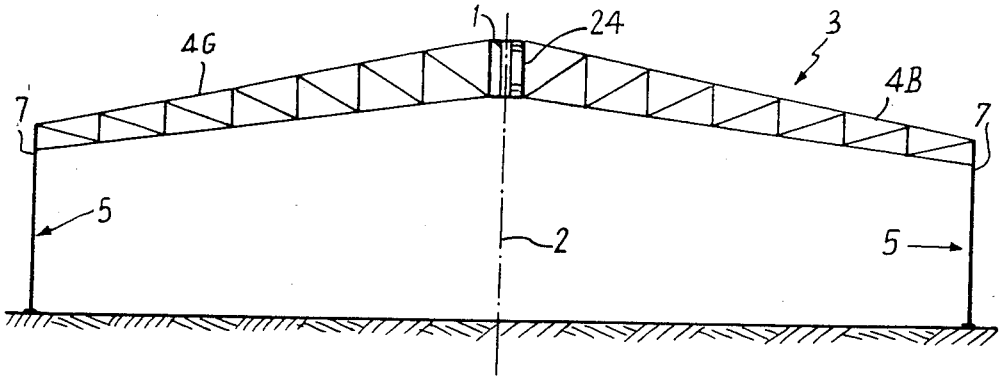
FIG. 1 is a general elevational view of a diagrammatic representation of a structure according to the invention used to support an awning acting as a roof.

The following description will set forth a number of secondary features of a structure according to the invention, the general design of which is illustrated in FIGS. 1 to 6. That design is that of an improved structure, as referred to hereinbefore, wherein there is a central hub 1 formed in this case by a cylindrical tube portion having a geometrical axis 2 which is also the general axis of the structure. The latter is generally identified by general reference 3. It comprises twelve trusses 4, the trusses 4A to 4L extending radially around the general axis 2 over a circular extent of 360° when the structure is in use, for example as the framework of a cover. The latter is advantageously an awning (not shown) which covers the whole of the structure and which closes and opens with the structure, as will be described hereinafter.

There is no central pole in the structure according to the invention. The structure in use thereof is supported above the ground by posts which are disposed at the free ends of the trusses 4A to 4L, or certain trusses; preferably the structure is supported by a pair of folding legs 5, like that shown in FIG. 3, which are respectively disposed between two successive trusses, at four locations which are in diametrally opposite relationship in twos, for example between the trusses 4B, 4C; 4E, 4F 4H, 4I; 4K, 4L. The description will explain hereinafter how the pairs 5 of folding legs can be provided and installed in a foldable manner, essentially comprising two legs 5A and 5B which are joined by two cables 6A and 6B which extend diagonally.

At their free ends the two successive trusses of any pair of trusses are connected by a frame 7 (see FIG. 3) which is disposed in a vertical plane and which is pivotally connected by way of its opposite ends respectively to the two trusses between which it is disposed, and is also provided with a vertical folding axis in its central plane between its ends. There are twelve frames 7A to 7L between the twelve trusses, as can be seen from FIG. 2; eleven of the frames 7A to 7F and 7H to 7L are folding and the twelfth frame 7G can be separated into two portions, as will be described hereinafter.

At its end towards the central hub 1 each truss 4A to 4L is fixed to a link and those links are pivotally connected together; they are not visible in FIGS. 1 to 6 but they will be described in greater detail in relation to the other Figures. Each link serves for pivotally mounting one end of a jack 8 (see FIG. 4) whose other end is pivotally connected directly or indirectly to a folding frame 7 corresponding thereto, between two adjacent trusses 4. There are eleven jacks 8A to 8K which are each disposed between two successive trusses (see FIG. 2). There is no jack between the two trusses 4G and 4H which are connected by the frame 7G which can be separated into two portions. In the embodiment described herein where the trusses 7 are each about 9 meters in length, there is an intermediate frame 9, approximately at the halfway location on the length thereof, the intermediate frame 9 being mounted parallel to the frame 7 between the two trusses 4 which are already connected at their free ends by that frame 7. There are eleven intermediate folding frames 9A to 9F and 9H to 9L and a twelfth frame 9G which can be separated into two portions. The intermediate frames 9 are pivotally connected by way of the ends to the trusses between which they are disposed. Each intermediate folding frame 9A to 9F and 9H to 9L is pivoted at its centre to an end of a corresponding jack 8, being jacks 8A to 8F and 8H to 8L respectively; in addition two inclined bars are each pivotally connected by way of their opposite ends respectively on the one hand to the end of a corresponding jack 8 and on the other hand to the central part of a corresponding half of the corresponding pivoted frame 7. There are seven pairs of inclined bars 10A to 10L and 11A to 11L. There are no inclined bars where there is no jack 3; that is to say, between the two trusses 4G and 4H connected by frames 7G and 9G which can be separated into two portions.

Figure 3:
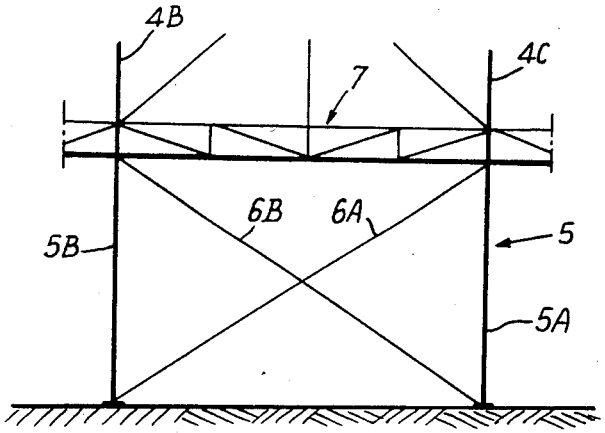
FIG. 3 is a diagrammatic view of part of the structure shown in FIG. 2, viewing in the direction of the arrow A in FIG. 2.
Figure 4:
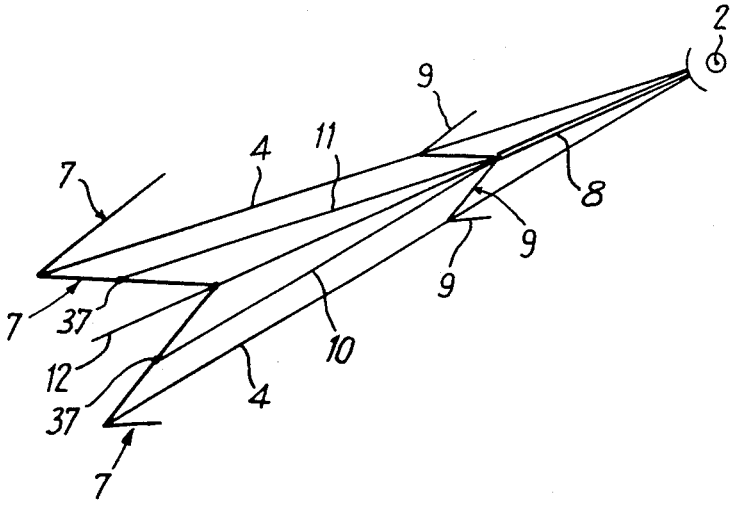
FIG. 4 is a diagrammatic plan view of part of the structure showing two frames between two trusses in the course of folding while said two trusses pivot into a mutually parallel position.

FIGS. 3 and 4 also show a rib or light support member 12 extending between each intermediate folding frame 9 and each folding frame 7. The light member 12 is fixed by one end to the top face of the intermediate folding frame 9 and it is guided slidably in the direction of its length on the top face of the folding frame 7. Its length is constant and it is neither folding nor telescopic so that it is in projecting relationship to the folding frame 7 when the frame 7 is folded under the action of the jack 8, as can be seen from FIG. 4. There are therefore eleven light members 12 (12A to 12K); they serve to support between the inclined bars 10 and 11, the awning material which covers the whole of the structure. It will be appreciated that different or additional light support members 12 may be provided, when deemed appropriate.

Figure 2:
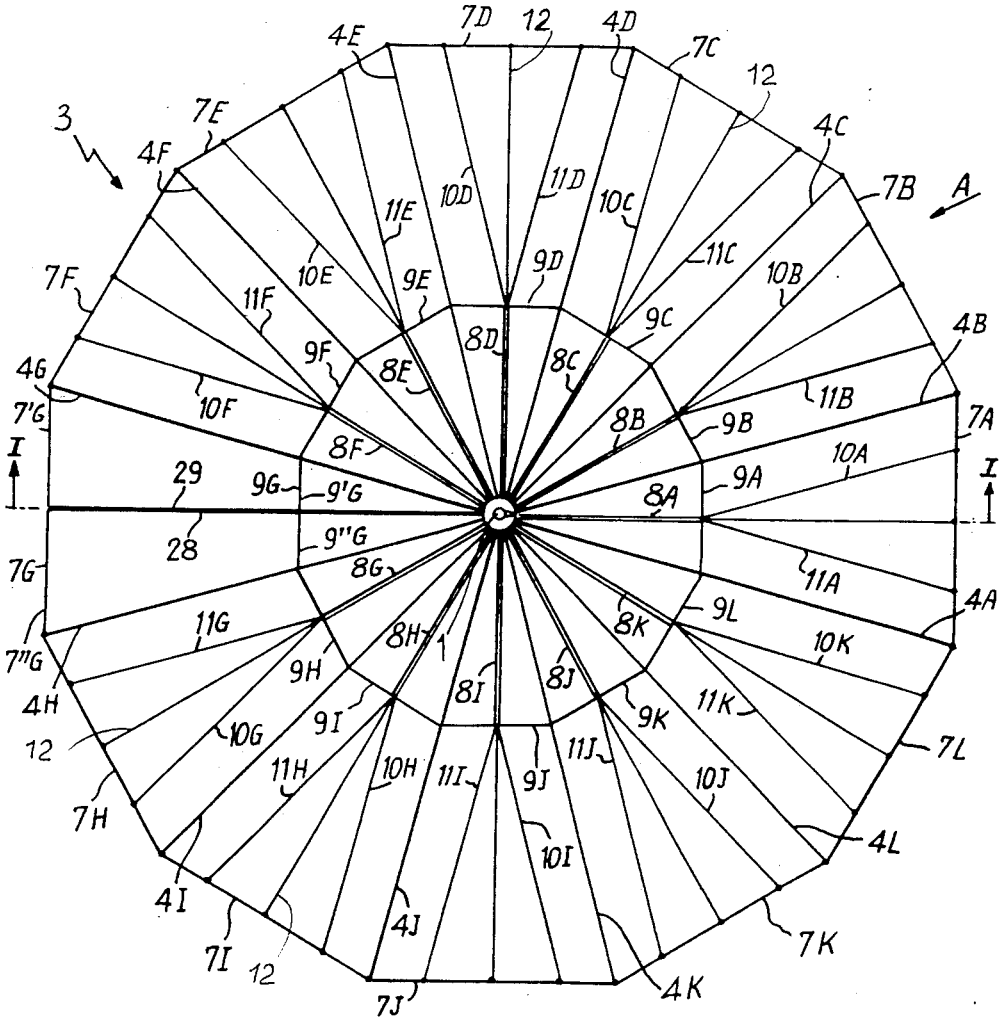
FIG. 2 is a diagrammatic view from above of the FIG. 1 structure, with the awning material being omitted.

FIGS. 1 to 3 show the unfolded or open structure in the condition of use thereof. FIG. 4 shows two trusses 4 being brought together during the folding or closure of the structure, when the frames 7 and the intermediate frames 9 fold in their centre towards the general axis 2 under the pulling force of the jacks 8.

Figure 5:
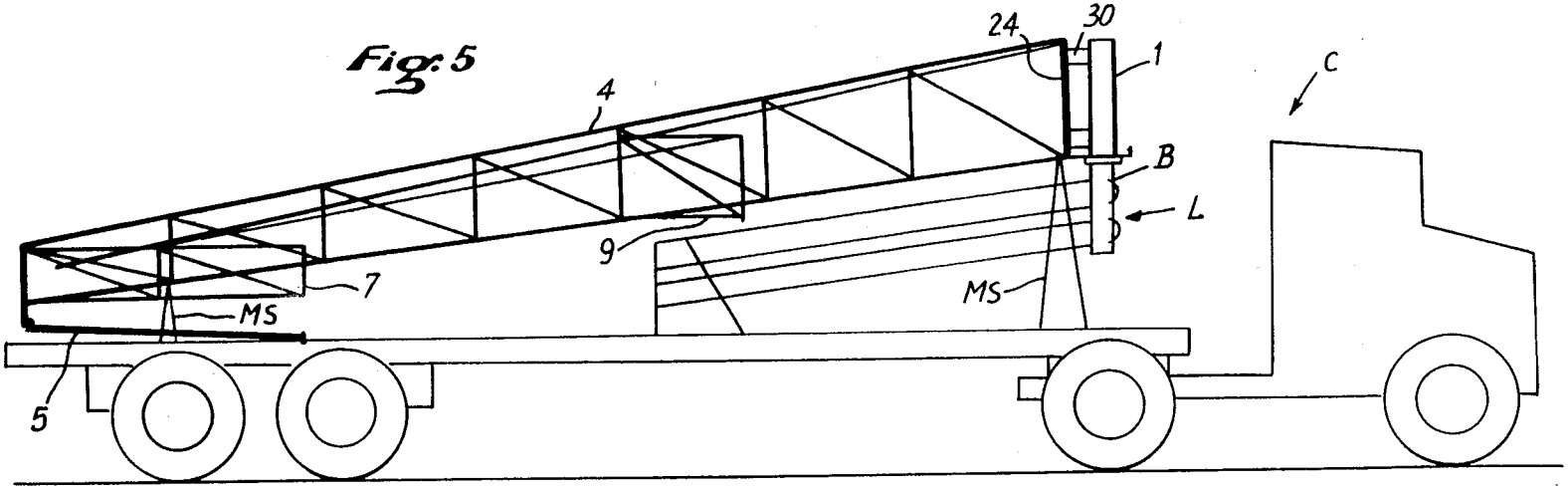
FIG. 5 is a general elevational diagrammatic view of the structure shown in FIGS. 1 and 2 in the folded condition, being supported by a vehicle for displacement thereof.
Figure 6:
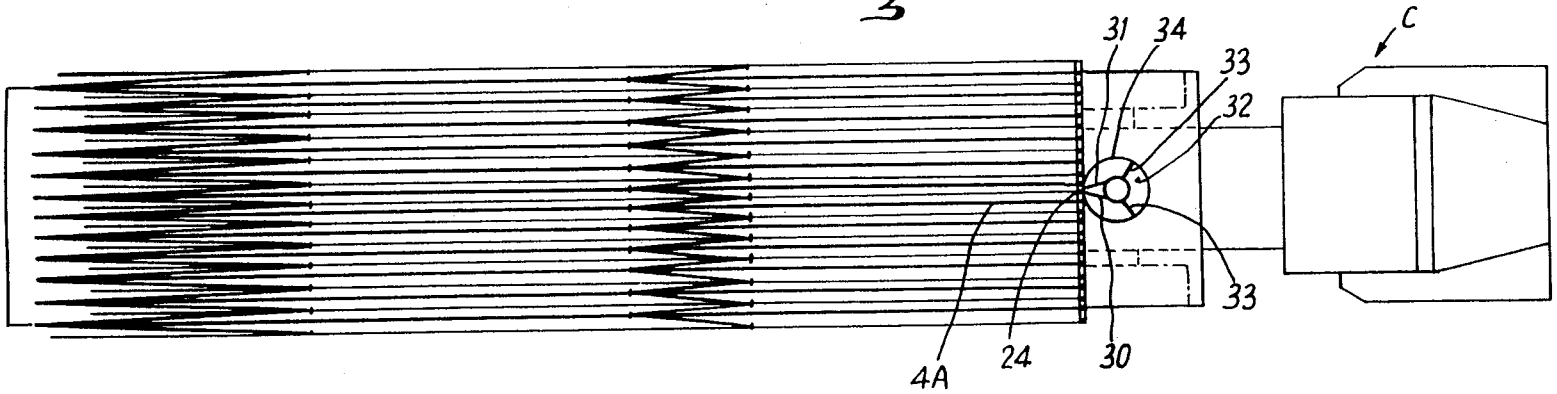
FIG. 6 is a diagrammatic plan view in the folded condition of the structure shown in FIG. 5 in the course of displacement.

The way in which the structure is put into the folded or closed condition as illustrated in FIGS. 5 and 6, to permit displacement thereof by means of a vehicle, will be described in greater detail hereinafter. Firstly, an embodiment of the different components will be described in detail, which will make it possible better to understand the closing and opening movements of the structure. The same reference numerals will be used as in relation to FIGS. 1 to 4.

Figure 7:
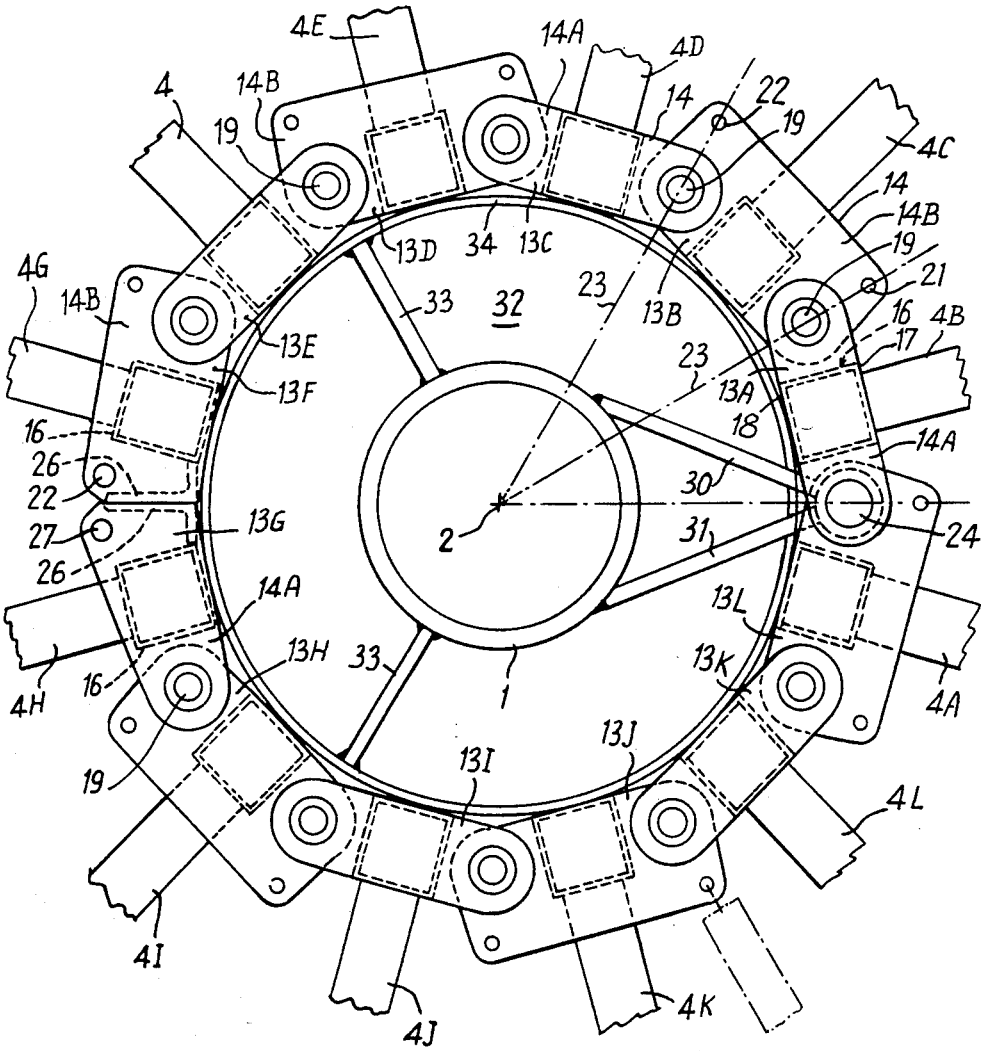
FIG. 7 is a plan view of the links of the structure shown in FIG. 1 when that structure is in use.
Figure 8:
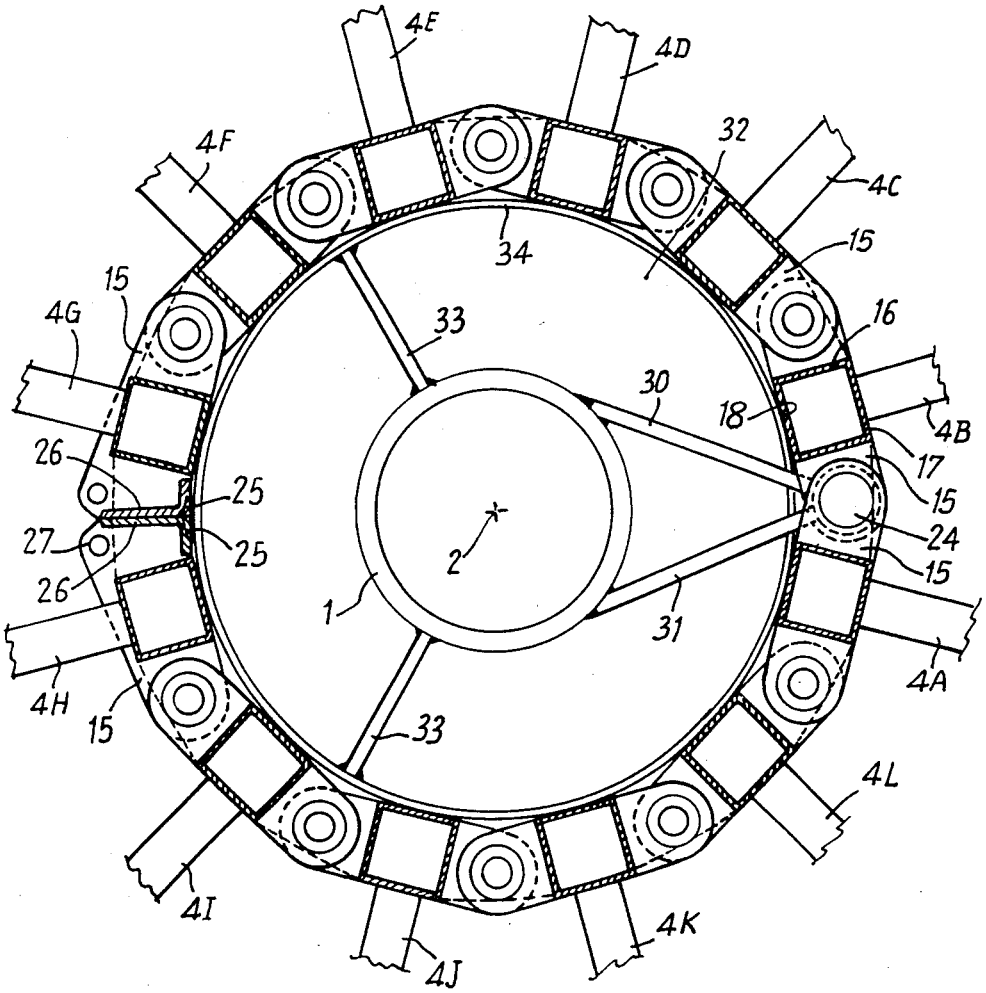
FIG. 8 is a plan view of the links of FIG. 7 in section through a horizontal plane passing at the mid-height level of the thickness of said links to show the lower part of the links.

FIGS. 7 and 8 clearly show the links 13 which are pivotally connected together like the links of a chain, each carrying a truss 4A to 4L and being disposed along a closed contour which is circular in this embodiment, about the geometrical axis 2 of the central hub 1, when the structure is in the condition of use as shown in FIGS. 1 and 2.

Figure 10:
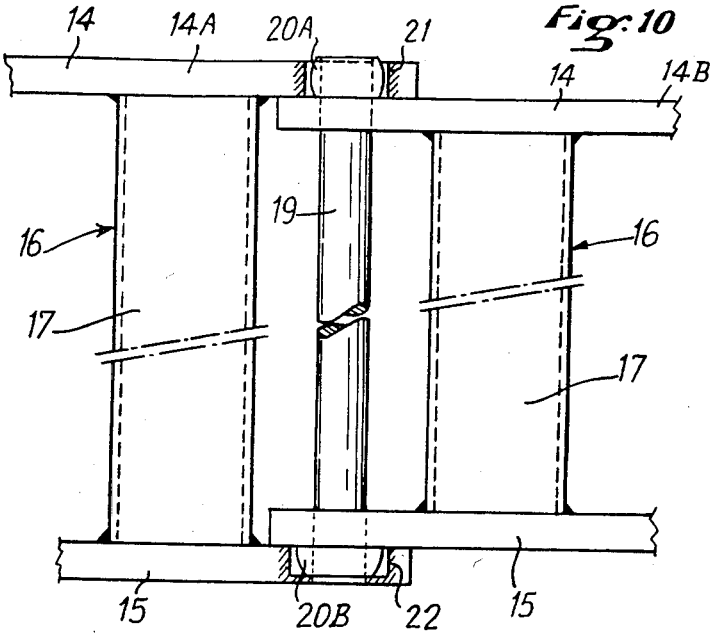
FIG. 10 is an elevational view of part of the structure showing the pivotal connection of two successive links.

FIG. 10 shows that each link 13 comprises an upper plate 14, a lower plate 15 and a cross bar 16. The cross bar 16 is preferably of square cross-section or it has at least one flat face 17 which is directed outwardly when the structure is in the unfolded or open condition. The plates 14 and 15 are parallel and horizontal in the position of use, being spaced in the vertical direction by the cross bar 16 by a distance equal to the height of a truss 4A to 4L. The flat face 17 serves for fixing one end of a truss. In an alternative embodiment, it would be possible to consider that each cross bar 16 is a terminal component portion of the truss to which it is fixed. However the invention does not impose the type of truss to be used although the lattice type is preferred to provide a high level of flexural rigidity combined with low weight. At any event the cross bar 16 is necessary to make up the links 13 and it also preferably has a second face 18 which is opposite to the face 17 and which is disposed in a plane substantially parallel to the face 17, the purpose of the second face 18 being described hereinafter.

The upper and lower plates 14 and 15 of the links 13 are connected and pivoted by means of axis members or shafts 19 which pass therethrough and which have heads 20A and 20B contained in recesses 21 and 22 provided in one plate in two. The recesses 22 containing the lower heads 20B are blind recesses which are closed downwardly.

The upper plates 14 are of two different kinds which are disposed in alternate succession. There are upper plates 14A of a width which is reduced to the width of the cross bars 16, and upper plates 14B which are increased in width in the direction of the trusses beyond the cross bars 16. The widthwise extension of the upper plates 14B is fairly substantial so that holes 21 and 22 can be provided therein in the additional width portion, the holes 21 and 22 being disposed on the bisecting line 23 which can be drawn in the angle between two successive trusses, as shown in FIG. 7 only between the trusses 4B, 4C and 4C, 4D. The holes 21 and 22 serve for pivotally connecting to the links 13 one of the ends of the folding and unfolding jacks 8A to 8K (not shown in FIGS. 7 and 8).

The lower plates 15 are of dimensions which are identical to each other and identical also to the dimensions of the reduced-width upper plates 14A.

The increased-width upper plates 14B and the lower plates 15 corresponding thereto are contained between the upper plates 14A and the lower plates 15 which correspond to the latter, as can be seen from FIG. 10.

The links 13 are mounted, preferably in equal numbers, on respective sides of a main pivotal shaft 24 which is vertical in the position of use. The main shaft 24 performs the function of a pivotal axis for the two first links 13A and 13L which are pivotally connected thereto by way of a first end portion, on two opposite sides of the shaft 24. Then, each link has the cross bar 16 for fixing a truss, in its central zone, and a second end portion by way of which it is pivotally connected to the following link by way of a secondary axis member or shaft 19, as described above. There are six links 13A to 13F and 13L to 13G on respective sides of the main pivotal shaft 24. In other circumstances, for structures of different dimensions, that number could be different. Likewise, it is not essential for the number of links and trusses to be the same on the two sides of the main shaft 24 although that is preferable for reasons of balance.

The succession of links 13 terminates on each of the sides of the main shaft 24 with a terminal link 13F on one side and 13G on the other side, which is different from the other links. In addition to the cross bar 16, those links 13F and 13G each have a right-angled member 25 between their upper and lower plates. The members 25 have a main limb 26 which is disposed radially with respect to the geometrical axis 2 and on the edge of the link so that the two limbs 26 are applied in back-to-back relationship as shown in FIG. 7 when the assembly of the links follows a closed contour. In addition the upper plate 14A of the terminal link 13G and the lower plates of the two terminal links 13F and 13G are modified by an increase in their width in the vicinity of the right-angled member 25 to provide a hole 27. The three holes 27 and the enlarged hole 22 in the upper plate 14B of the terminal link 13F serve for fixing members which are intended to be applied against each other and to be fixed to each other in order to hold the structure in the unfolded condition with its terminal links in contact with each other; those members are diagrammatically illustrated at 28 and 29 in FIG. 2.

For structures of small dimensions, the main pivotal shaft 24 may serve for lifting and carrying the structure for displacement thereof, as will be described hereinafter.

For substantial structures, for example 9 meters and more in respect of the length of each truss 4, there is a central hub 1 concentrically with respect to the geometrical axis 2. In the absence of the central hub 1, the geometrical axis 2 constitutes both the general axis of the closed contour along which the links 13 are disposed in use of the structure, and the general axis of the structure in the unfolded condition.

When the structure includes the central hub 1, it carries the main pivotal shaft 24 by means of two inclined arms 30 and 31 which are rigidly fixed on the one hand to the outside surface of the central hub 1 and on the other hand to the main pivotal shaft 24 between the upper and lower plates of the links 13A and 13A which are pivotally connected to the shaft 24. In addition a ring 32 is fixed to the outside surface of the central hub 1; it is reinforced by two radial bars 33 for holding in concentric relationship with the central hub 1 a perimetric guide 34 which is disposed on the closed contour along which the links 13 are disposed in use of the structure. The perimetric guide 34 is a plate which is closed to itself in a cylindrical configuration in the present embodiment, equal in height to the height of the links 13, and concentrically with the geometrical axis 2. The purpose thereof is to make it easier to set the links 13 in position along the closed contour, acting as a support for the second face 18 of the cross bars 16. In the event that the closed contour should be square or rectangular, the perimetric guide 34 would be of a consequential configuration.

FIGS. 9 and 11 to 13 relate to the design of certain parts of the structure, in respect of which it is possible to adapt a wide range of different constructions.

Figure 9:
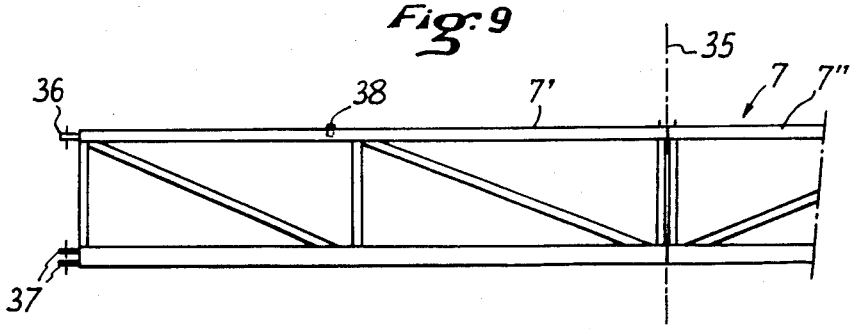
FIG. 9 is a front elevational view of one of the folding frames which connect two successive trusses.

FIG. 9 shows a folding frame 7 which connects the free ends of two successive trusses 4 and which constitutes a stringer beam in the structure. It is a lattice beam made in two halves 7' and 7'' which are hingedly assembled together with a folding axis as indicated at 35 at the middle of the entire beam. The opposite ends thereof are connected pivotably about suitable axes to the trusses 4 by means of lugs 36 and 37. Provided on each half 7' and 7'' substantially at the middle thereof is a lug 38 for pivotal connection to an inclined bar 10 or 11 for connection to a folding and unfolding jack 8.

In the sector where the terminal links 13F and 13G meet, the frame 7G (FIG. 2), is not a folding frame but can be separated into two portions 7'G and 7''G which meet in end-to-end relationship and which are locked together during use of the structure.

Figure 11:
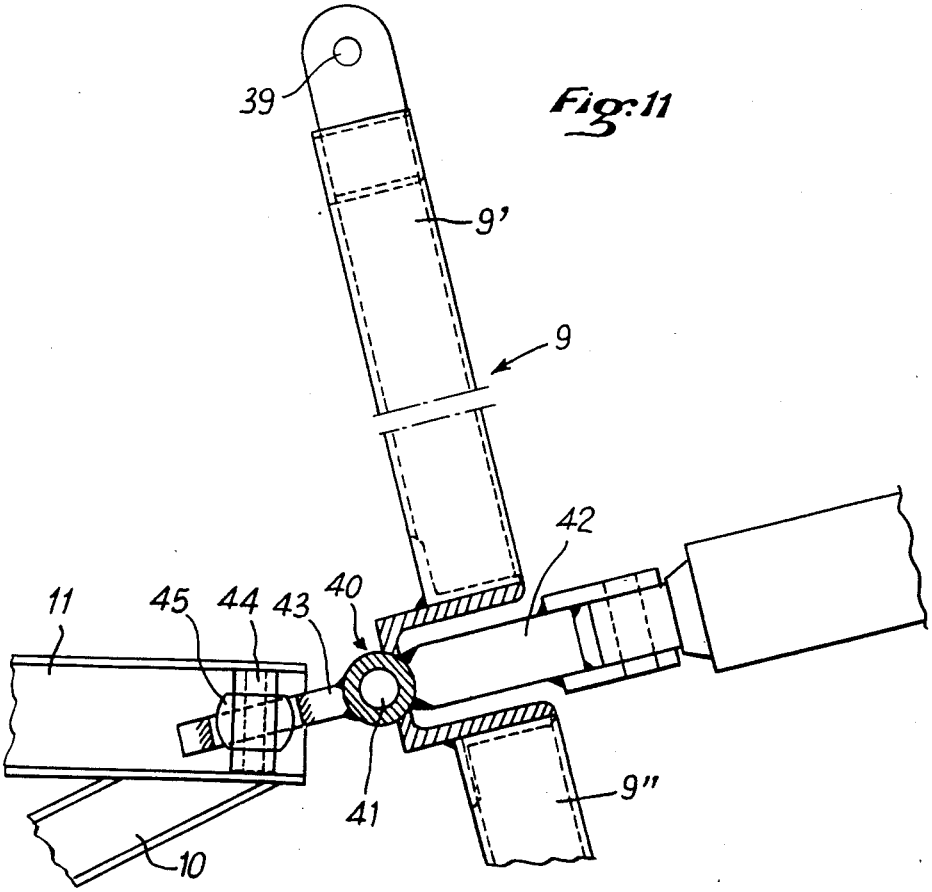
FIG. 11 is a plan view of part of the structure showing the pivotal connection of a folding and unfolding jack to an intermediate frame pivotally mounted between two successive trusses.

As already described, structures of larger size include, between the successive trusses 4, an intermediate folding frame 9 which is disposed substantially at the halfway location in respect of the length of the trusses 4. FIG. 11 shows that such a folding frame which can also be made in the form of a lattice beam comprises two halves 9' and 9'' which are pivoted by way of their opposite ends to a truss by means of a vertical axis 39. At its centre, each intermediate frame 9 comprises a hinge-type assembly 40 having an axis 41. Fixed to the elements of the hinge 40 on the side of the central axis 2 is a first pivot member 42 to which there is pivotally connected an end of a jack 8 whose other end is pivotally connected to a link 13. Fixed on the opposite side, to the same elements of the hinge 40, is a second pivot member 43 which serves for pivotal mounting by means of a spindle 44 and a bush 45 having a spherical outside surface, of an inclined bar 11 which comes from the half 7' of the folding frame 7; the other inclined bar 10 which comes from the half 7" of the same folding frame 7 is pivotally connected in the same manner, at a lower level, to the second pivot member 43.

In that way, the jacks 8 make it possible to fold or unfold the frames 7 and the intermediate frames 9 and to move the trusses 4 towards or away from each other, as can be seen from FIG. 4.

In the sector where the terminal links 13F and 13G meet, the intermediate frame 9G (see FIG. 2) is not foldable but can be separated into two portions 9'G and 9"G which meet in end-to-end relationship and which are locked to each other in use of the structure. In that same sector, there is no jack 8 or inclined bar 10, 11.

Figure 12:
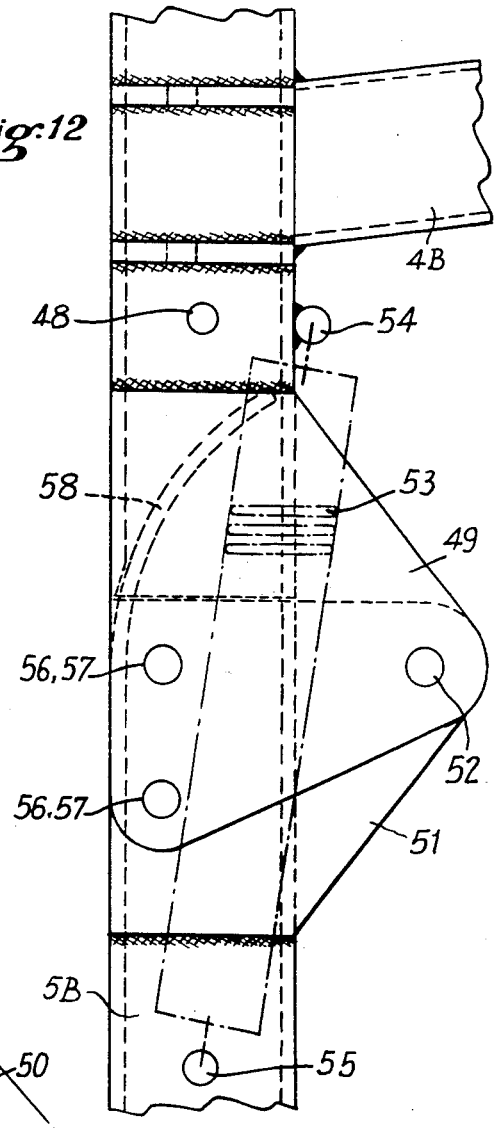
FIGS. 12 and 13 are side views of part of the structure showing the pivotal mounting of a post or support gantry to a second end of a truss, said support member being respectively in a support position, and in a rest position.
Figure 13:
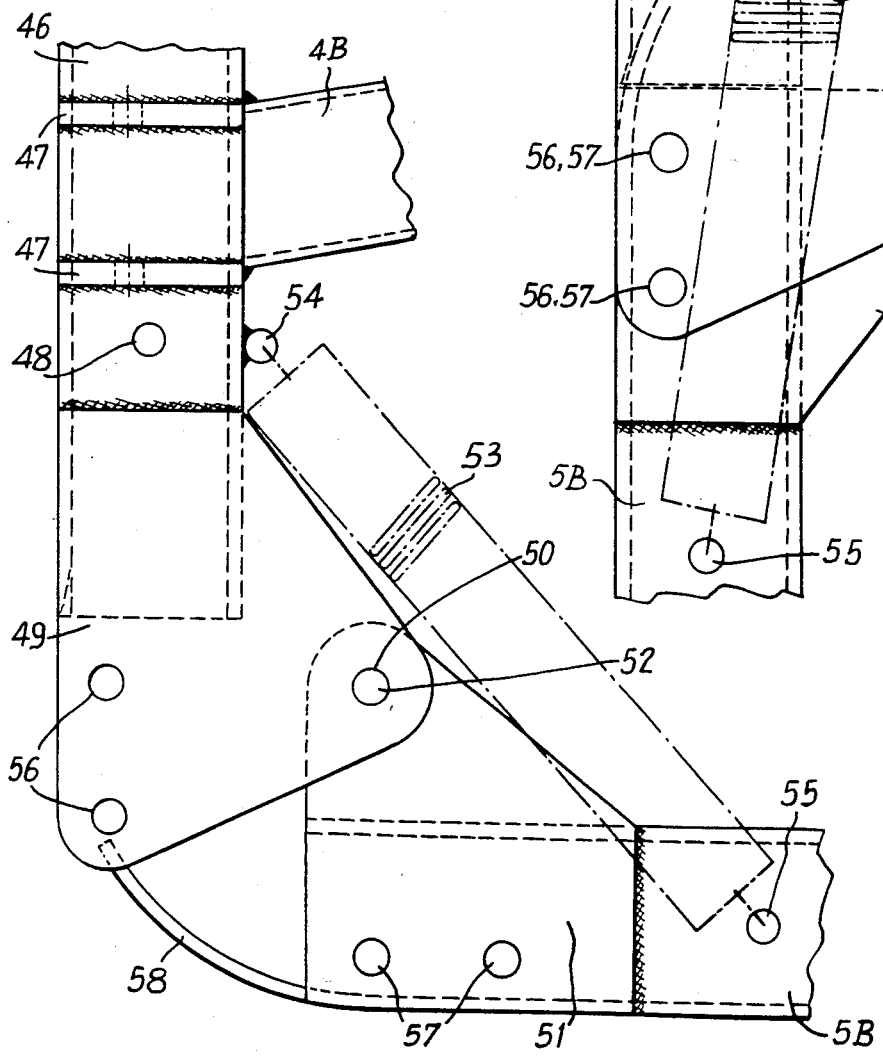

FIGS. 12 and 13 show an example of the assembly of the pairs 5 of folding legs 5A and 5B. A lower beam of a truss, for example 4B, is fixed to a vertical element 46 which on two opposite sides carries lugs 47 permitting pivotal connection thereof to a folding frame 7 by way of the lugs 37 on the latter. The vertical element 46 is extended below the folding frame 7 and, in that extended portion, is pierced with a hole 48 and provided with two hanging lugs 49. The lugs 49 are extended inwardly in the direction of the geometrical axis 2 and have a pivotal connecting hole 50. Each folding leg, for example 5B, is provided at its top with two similar lugs 51 which have a pivot connecting hole corresponding to the hole 50, to receive an axis member or spindle 52. The latter is therefore displaced inwardly with respect to the folding frame 7, in use of the structure. A return spring 53 is attached on the one hand to the vertical element 46 at a point 54 and on the other hand to the folding leg 5B at a point 55. The arrangement is such that the spring 53 is disposed on one side of the spindle 52, towards the interior, when the leg 5B is set in a horizontal position (see FIG. 13) and on the other side, towards the outside, when the leg 5B is set in the vertical position (see FIG. 12). In both cases the spring 53 holds the leg 5B in the position in which the leg has been put. Additional holes 56 and 57 are provided in the lugs 49 and 51 so as to be in a position of alignment when the leg 5B is in a vertical position (as shown in FIG. 12) to receive pins for locking the leg in that position.

The hole 48 serves for fixing the upper end of each cable, for example 6B, which extends diagonally between the legs 5A and 5B.

Preferably, a plate 58 which is curved in a circular arc is fixed to the lugs 51; it has the same geometrical axis as the pivot axis 52 and closes the gap between the lugs 49 and 51 when the leg 5B is in a horizontal position. The purpose thereof is to prevent the awning material which covers the structure and which can extend down to the ground being pinched between the lugs 49 and 51 when the legs 5 are set in their vertical position.

FIGS. 5 and 6 show the folded condition of the structure which has just been described above in the unfolded condition. From the unfolded condition, when the structure is supported by the legs 5, a vehicle C is introduced at the centre. The vehicle is fitted with a lift means S which is terminated with a rod B designed to be introduced into the interior of the central hub 1. The whole of the structure is lifted above the ground by means of the lift device S, the legs 5 are unlocked and they are put into their horizontal position.

When the terminal links 13F and 13G have been released from each other, as well as the members 28 and 29 and the mutually detachable halves 7'G, 7"G and 9'G and 9"G of the separable frames 7G and 9G, the jacks 8A to 8K are set in operation in the direction of retraction thereof to fold the frames 7 and 9 inwardly (see FIG. 4) and to bring the trusses 4A to 4L towards each other. From the main pivotal shaft 24, the links 13A to 13F on the one hand and 13L to 13G on the other hand are moved into a position of rectilinear alignment, as shown in FIG. 6. The structure is lowered by lowering the lift means S until the structure rests on support means MS provided on the vehicle C. The structure can then be displaced, with the trusses 4 being parallel one against the other.

For using the structure at another location, operation is in the reverse sequence. The structure is first lifted above the vehicle until the legs can then be put into a vertical position; the frames 7 and 9 are successively unfolded from the central pivotal shaft 24 to put the links 7 into the configuration of the closed contour provided, around the perimetric guide 34, by means of the jacks 8, the terminal links 13F, 13G, the members 28 and 29 and the halves of the dismantleable frames 7G and 9G are locked together, the legs 5 are set into the vertical position and then the structure is lowered until it rests on the ground by way of the legs 5. The rod B of the lift means S is disengaged from the central hub 1 and the vehicle C is removed.

By virtue of the invention, folding, displacement and unfolding of the structure require a small number of operating personnel and are quick to carry out.

I claim:

1. A displaceable openable and closable cover structure comprising:

a main pivotal shaft (24) which is vertical in position in use of the structure, two first links (13) which are horizontal in use and which are each pivotally connected by way of a first end portion about the main pivotal shaft (24) respectively on two opposite sides of the shaft (24), a succession of supplementary links (13) which follow each other from each of the two first links (13), the number thereof being determined by the size of the structure, said links being pivotally connected together in twos by way of their end portions, each link (13) having between its end portions a central truss fixing zone (16), the succession of links (13) on each side of the main pivotal shaft (24) respectively terminating with a terminal link (13F, 13G) having a free end provided with a support and fixing means (26, 27) for fixing them to each other when the links (13) have been disposed in a closed contour, trusses (4) respectively fixed by one end to a corresponding link (13), to the central zone (16) thereof, and each extending substantially perpendicularly to said link, at least one frame (7) extending in use in a vertical plane between two successive trusses (4), each frame (7) being pivotally connected by its opposite ends to the trusses (4) that it connects and itself being pivoted at its centre about a vertical axis (35) to be folding while the frame (7G) which in use connects the trusses (4G, 4H) of the terminal links (13F, 13G) can be dismantled into two portions (7'G, 7"G), a jack (8) pivotally connected by way of one end to a link (13) between the two links of each pair of successive pivotally interconnected links, said jack (8) being pivotally connected by way of its opposite end to the corresponding folding frame (7) or to at least one connecting bar (10, 11) pivotally connected to said folding frame (7) and removable legs (5A, 5B) which are preferably foldable and which are mounted at the free end portion of certain trusses (4) which are in opposite relationship in use of the structure

2. A structure according to claim 1 further comprising a central hub (1) having a geometrical axis (2) which is vertical in use, being connected by arms (30, 31) to the main pivotal shaft (24) to carry the latter, said geometrical axis (2) being the general axis of the structure when the structure is in use.

3. A structure according to claim 2 wherein the central hub (1) is a hollow cylinder.

4. A structure according to claim 2 wherein at the level of the links (13), around the geometrical axis (2), the central hub (1) carries a perimetric guide (34) which provides a closed contour and against which the links (13) are applied in use of the structure by way of a face (18) opposite to the face (17) from which the trusses (4) extend.

5. A structure according to claim 1 wherein each folding frame (7) and the dismantlable frame (7'G, 7''G) are disposed between the free ends of the trusses (4), which are remote from the links (13).

6. A structure according to claim 5 wherein between the successive trusses (4) there is at least one intermediate frame (9) which in use is disposed in a vertical plane parallel to the corresponding folding frame (7), said intermediate frame (9) being pivotally connected by way of its end to the trusses that it connects and itself having a central folding axis (41), each intermediate frame (9) being pivotally connected at its centre to an end of the corresponding jack (8) and being connected by at least one connecting bar (10, 11) to said folding frame while the intermediate frame (9G) which in use connects the trusses (4G, 4H) of the terminal links (13F, 13G) can be dismantled into two portions (9'G, 9''G)

7. A structure according to claim 5 wherein the removable legs (5A, 5B) are mounted below the opposite ends of a plurality of folding frames (7B, 7H, 7E, 7K) which are disposed at locations which are in opposite relationship in twos in use of the structure, each leg (5A, 5B) being pivotally connected by means of a horizontal axis (52) to an end of the corresponding frame, locking means (56, 57) being provided on the frame and on the leg to be in a condition of correspondence when the leg is in the position of use.

8. A structure according to claim 7 wherein said horizontal axis (52) is displaced towards the interior of the structure with respect to the corresponding frame (7) in use and a return spring (53) is attached to on the one hand of the folding frame (7) and on the other hand to the leg (5A, 5B) to be disposed on one side of said axis (52) in the vertical position of use and in a horizontal position.

9. A structure according to claim 1 wherein each link (13) comprises an upper plate (14), a lower plate (15) and a cross bar (16) rigidly connecting said two plates (14, 15) by way of their central zone, said cross bar (16) holding said plates (14, 15) in spaced relationship in a vertical direction at a distance equal to the height of a truss.

10. A structure according to claim 9 wherein each cross bar (16) has a flat face (17) which is directed towards the exterior when the structure is in the unfolded or open condition and which serves for fixing a truss (4).

11. A structure according to claim 9 wherein one link in two has an upper plate (14A) of enlarged width, in which there are provided two holes (21, 22) for pivotal connection of an end of a jack (8), said holes (21, 22) being respectively disposed on the line bisecting the angle of two successive trusses (4) when the structure is in the unfolded or open condition.

* * * * *